US005839507A

United States Patent [19]

Jensen

[11] Patent Number: 5,839,507

[45] Date of Patent: Nov. 24, 1998

[54] HOUSEHOLD REFRIGERATOR

[75] Inventor: Michael Hamish Jensen, Auckland, New Zealand

[73] Assignee: Fisher & Paykel Limited, Auckland, New Zealand

[21] Appl. No.: 850,195

[22] Filed: May 2, 1997

[30] Foreign Application Priority Data

May 3, 1996 [NZ] New Zealand ..... 286508

[51] Int. Cl.[6] ..... F25D 23/04

[52] U.S. Cl. ..... 165/263

[58] Field of Search ..... 165/263, 264

[56] References Cited

U.S. PATENT DOCUMENTS

| | | | |
|---|---|---|---|
| 2,303,806 | 12/1942 | Wild | 165/264 |
| 2,378,816 | 6/1945 | Wild | 165/263 |
| 2,579,848 | 12/1951 | Nave | 165/263 |
| 2,627,393 | 2/1953 | Shell | 165/263 |
| 2,658,727 | 11/1953 | Eck | 165/263 |
| 2,724,576 | 11/1955 | Jacobs | 165/263 |
| 2,773,677 | 12/1956 | Hinkel | 165/263 |
| 2,953,357 | 9/1960 | Long | 165/263 |
| 3,043,569 | 7/1962 | Armentrout | 165/263 |
| 4,879,878 | 11/1989 | Polkinghorne | 62/187 |

*Primary Examiner*—William W. Tapolcai

*Attorney, Agent, or Firm*—Trexler, Bushnell, Giangiorgi & Blacsktone, Ltd.

[57] ABSTRACT

A refrigerator 1 has a cabinet 2 including a fresh food compartment 5. A door 7 hinged from one side of the refrigerator cabinet 2 is closaeable to enclose the fresh food compartment. A butter conditioner 11 is mounted on the door 7. A refrigerator light 10 is positioned so that with the door 7 in a closed position the butter conditioner 11 is positioned in close proximity to the light 10. The light 7 is operated with the door 7 closed to provide heating effect to the conditioner 11. The conditioner 11 may optionally be a removable thermally insulated container. A heated butter conditioner is mounted in a refrigerator door without an electrical connection across the door hinge.

9 Claims, 4 Drawing Sheets

HOUSEHOLD REFRIGERATOR

BACKGROUND OF THE INVENTION

1. Field of the Invention

This invention relates to household refrigerators and in particular to the provision of butter conditioning compartments in refrigerators.

2. Description of the Prior Art

Household refrigerators commonly include separate freezer and fresh food compartments, the freezer compartment being maintained at a substantially colder temperature than the fresh food compartment, generally about −15° C. The fresh food compartment is generally maintained at around 3° C. The fresh food compartment may for example be used to store fruit and vegetables, dairy products, chilled liquids and other food stuffs which would otherwise be adversely affected by extended periods at standard room temperature, but are not desired to be frozen.

The temperature of the fresh food compartment can however have an adverse aesthetic effect on the food product, particularly in the case of butter. The material properties of butter are greatly affected by its temperature. At room temperature, particularly in warm climates, butter is often subjectively considered to be too soft. Fo this reason and for reasons of hygiene, it is generally considered best to keep butter in the refrigerator fresh food compartment. However, at the general temperatures of fresh food compartments in refrigerators, butter is subjectively too hard. At such a temperature its hardness is such that it is difficult to spread and is difficult to work, in for example the creation of baked products such as pastries and cakes. To this end it has become a reasonable practice in the design of refrigerators to include a butter conditioning compartment which may be heated or otherwise maintained at a temperature between the standard temperature of the fresh food compartment of a refrigerator and the outside room temperature. This compartment is itself generally located within the fresh food compartment of the refrigerator, for example integrally made as part of the refrigerator cabinet. The butter conditioner when located in the fresh food compartment effectively blocks the use of space located therebehind.

Locating the butter conditioner in a refrigerator door necessitates the maintenance of an electrical connection between the refrigerator cabinet and the refrigerator door, for the conduction of electricity to the butter conditioner heating elements. This adds complexity in the production of the refrigerator, and removes the capability of having the door easily hung from either side of the refrigerator cabinet, depending on an individual consumer's requirements.

SUMMARY OF THE INVENTION

It is therefore an object of the present invention to provide a household refrigerator which will at least go some way towards overcoming the above disadvantages, or will at least provide the public with a useful choice.

Accordingly in one aspect the invention consists in a refrigerator comprising:

an open fronted cabinet enclosing, but for said open front, a refrigeration space, a door connected to said cabinet to cover said open front when closed and to give access to said refrigerated space when open, a refrigeration system to refrigerate said refrigeration space, an enclosed subcompartment, said subcompartment supported on the door of said refrigerator, and a heating means in said cabinet, said heating means located in said cabinet proximate to said subcompartment with said door closed.

In a second aspect the invention consists in a refrigerator which includes a butter conditioner characterised in that a passive butter compartment is mounted in the refrigerator door and that an incandescent light bulb is mounted in the refrigerator in a position such that the bulk of the radiation from the light bulb is received by the butter compartment when the refrigerator door is closed.

In a third aspect the invention consists in a method for controlling the supply of power to a light in the fresh food compartment of a refrigerator comprising:

monitoring the state of the door of the refrigerator, supplying a substantially constant and preset amount of power to said refrigerator light when the door is in an open position, and with the door in a closed position supplying energy to said light at an overall rate dependent on a user setting.

In a fourth aspect the invention consists in a refrigerator including:

a compartment and a door to close said compartment, an electrically energisable light in said compartment, a power supply mean for supplying a controlled amount of power to said light, detecting means for detecting the open state of said refrigerator door, said detecting means returning an indication of said state when queried, user variable setting means which return an indication of its user setting when queried, and control means which query said detecting means and said setting means, and control the output of said power supply such that with said detecting means returning an indication of an open door state said power supply is caused to supply a preset constant power to said light, and with said detecting means returning an indication of a closed door state said power supply is caused to supply an amount of power to said light which is dependent on said user setting.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWINGS

One embodiment of the present invention will now be broadly described with reference to the accompanying drawings in which.

DESCRIPTION OF TIE PREFERRED EMBODIMENT

Figure 1:
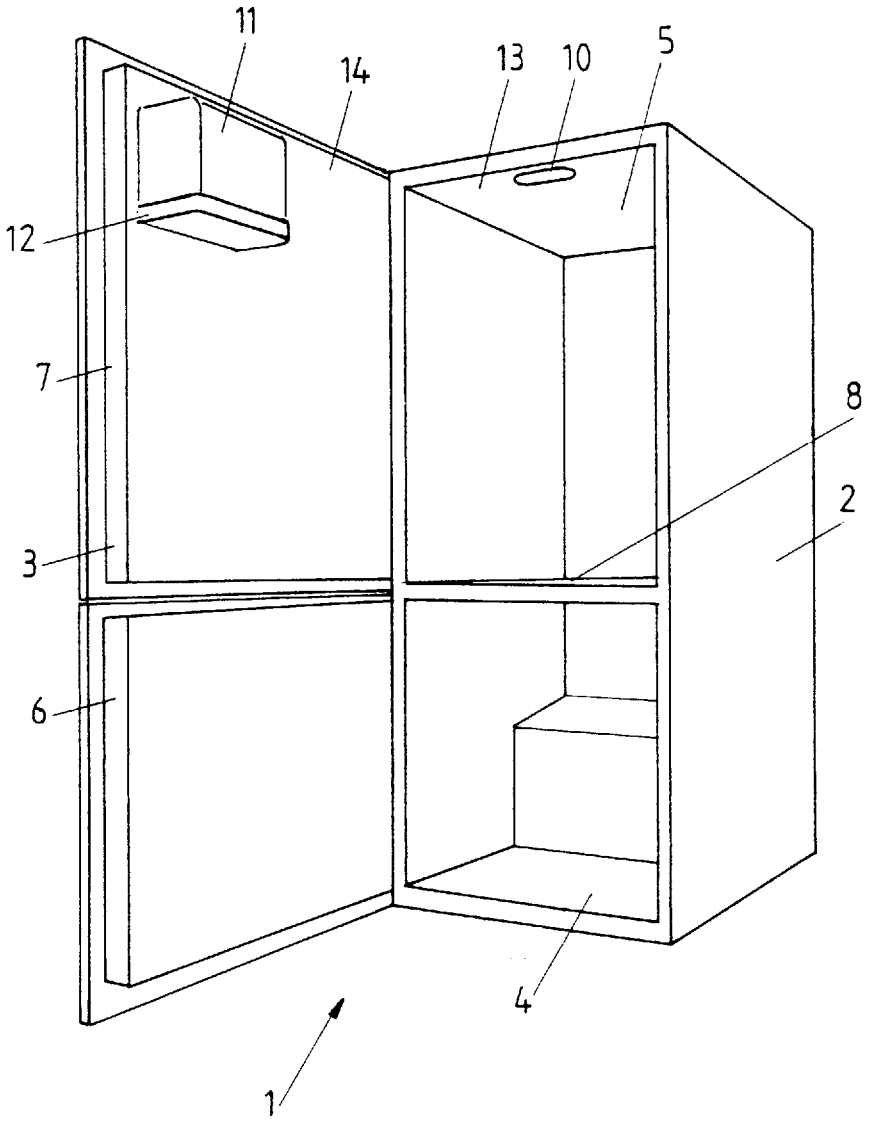
FIG. 1 is a perspective view of a two-compartment household refrigerator with doors open, showing a butter conditioner according to the present invention

With reference to FIG. 1, a household refrigerator 1 is shown having a cabinet 2 including a freezer compartment 4 and a fresh food compartment 5 separated by an insulating partition 8. Doors 6 and 7 hinged from one side of the refrigerator cabinet 2 about hinge 9 are closable to enclose the freezer compartment 4 and fresh food compartment 5 respectively.

Figure 2:
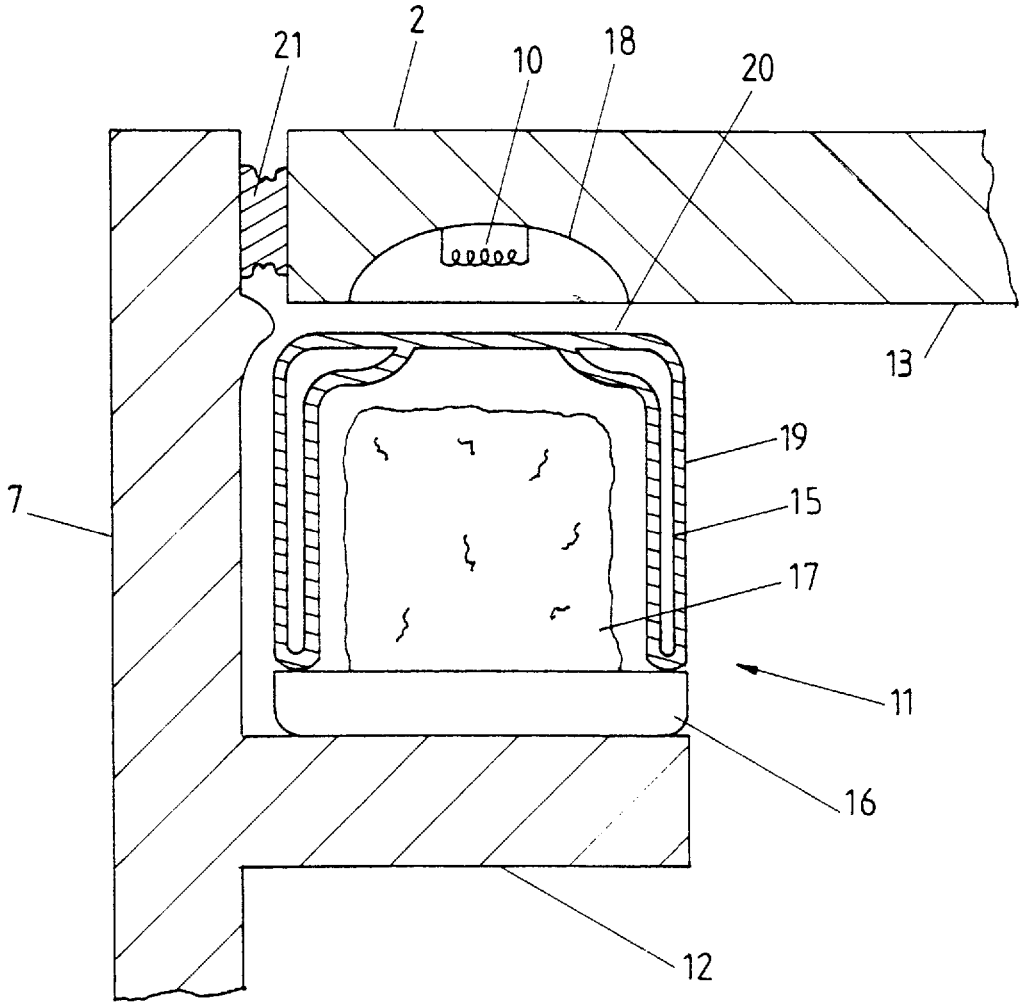
FIG. 2 is a cross-sectional side elevation of the front upper portion of a refrigerator like that of FIG. 1.
Figure 3:
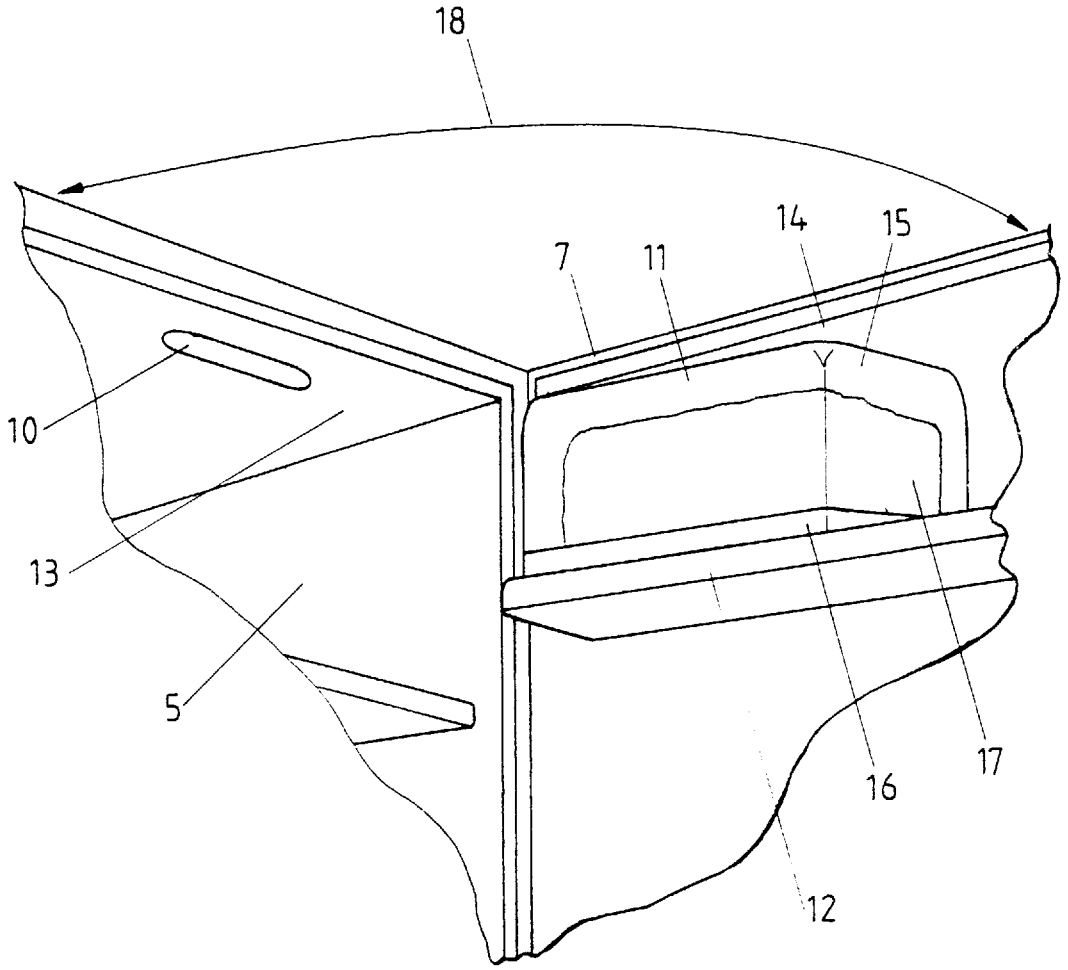
FIG. 3 is a perspective view of the portion of the refrigerator shown in FIG. 2 with the door open.

Referring to FIGS. 1 to 3, the refrigerator of the present invention includes a butter conditioner 11 mounted on the door 7 adapted to enclose the fresh food compartment 5. A heating means 10 is located inside the refrigerator fresh food compartment 5. Closure of the fresh food compartment door 7 causes the butter conditioner to come into substantial registration with the heating means 10, allowing heat transfer between heating means 10 and butter conditioner 11, to thereby maintain the butter conditioner 11 at a temperature elevated above the temperature of the fresh food compartment 5.

The butter conditioner 11 comprises a self-contained removable unit, which when in place in the refrigerator sits on a shelf 12 integrally formed with the fresh food compartment door 7. The shelf and container are such that with the door 7 closed the container is located within the fresh food compartment adjacent the inside ceiling thereof. This self-contained unit may for example as shown in the drawing comprise a tray 16 and a cover 15, with in use the block of butter 17 positioned on the tray 16 and covered by the cover 15. To insulate the elevated temperature inside the conditioner from the lower temperature surrounding air in the fresh food compartment, the butter conditioner tray 16 and/or the butter conditioner lid 15 preferably are formed having a double wall 19. It is preferred however that an area of the butter conditioner lid is formed having a substantially lower insulative property in position to be in registration with the heating means 10 with the refrigerator fresh food compartment door 7 closed and the butter conditioner unit 11 in place on the shelf 12. This may comprise for example an area 20 of only single wall thickness in the conditioner lid 15. It could also comprise an opening in the conditioner lid, but this is less preferable as it would encourage the escape of heat from the conditioner through convection.

The shelf on which the conditioner sits is preferably provided with indentations or ribs which cooperate with the shape of the butter conditioner tray to locate the conditioner accurately on the shelf. This ensures the accurate positioning of the refrigerator light above the conditioner with the door in a closed position.

Although described as a self contained and removable unit the butter conditioner 11 could be an integral unit with the refrigerator door, such as a compartment having a hinged door into which an open butter tray is placed.

In the preferred form of the invention the heating means 10 doubles as the refrigerator light when the door is open. The heating means 10 preferably comprises an incandescent light bulb. The heating means 10 is located in the ceiling 13 of the fresh food compartment 5 close to the front edge thereof. The heating means 10 is preferably located in a shallow recess 18 in ceiling 13. With refrigerator door 7 closed and the butter conditioner 11 in place below the heating means 10, the top surface of the butter conditioner effectively covers the area below the recess 18, thereby causing a substantial proportion of the heat from the incandescent light bulb 10 to be transferred into the butter conditioner 11, either by direct radiation or by convection.

Figure 4:
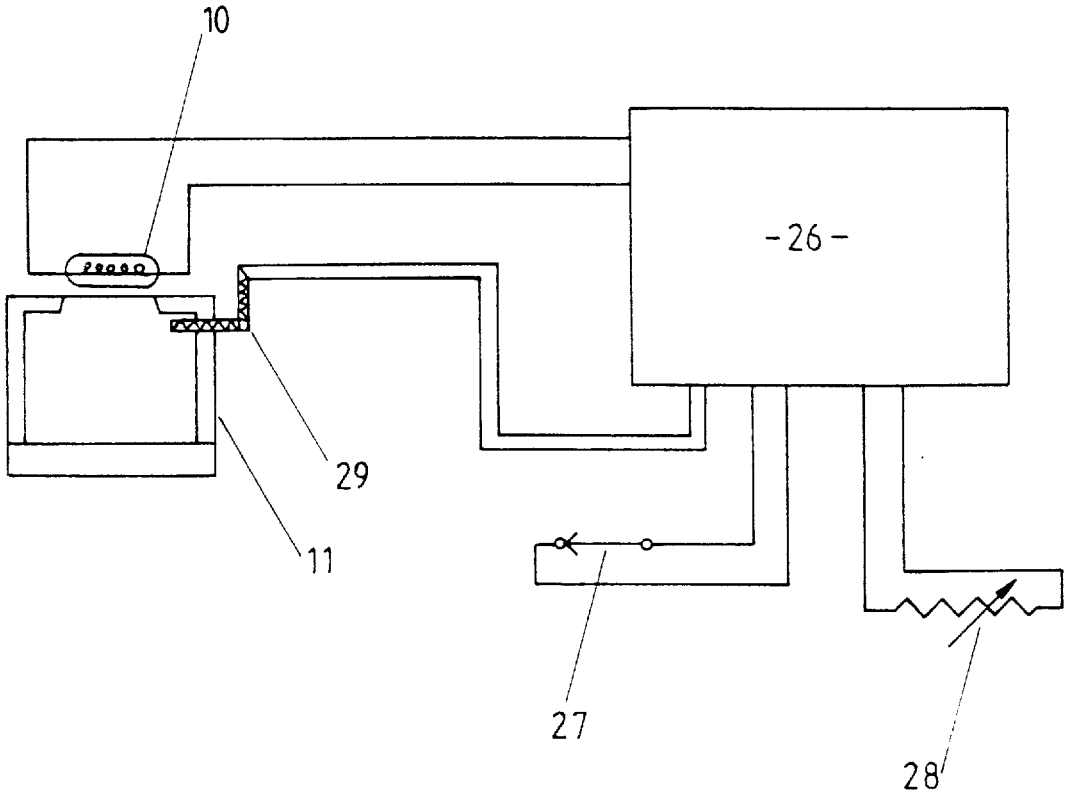
FIG. 4 is a diagramatic representation of the control system for the butter conditioner of the present invention.

Referring to FIG. 4, a control system is shown for controlling the supply of power to said incandescent bulb to thereby control the heat supplied to the butter conditioner 11. The control system 25 includes power supply means 26 which selectively controls the supply of power to the incandescent bulb 10, for example by cycling on and off the supply of power to the incandescent bulb 10. The power supply means 26 receives inputs from door status switch 27 and user variable control 28. Door status switch 27 is activated in accordance with the door being in an open/closed position. Such door activated switch is currently commonly used to cause operation of the refrigerator light when the door is open. User variable control 28 is settable by the user of the refrigerator in accordance with their desired butter condition. Variance of this control allows the user to vary upwardly or downwardly the level of supply of power to the incandescent bulb 10 with the door in a closed position, to thereby vary the temperature inside the butter conditioner 11. The power supply means 26 preferably fully energises the incandescent bulb 10 with the door in an open position as indicated by door status switch 27. With the door in a closed position as indicated by the door status switch 27, the power supply means 26 preferably varies the duty cycle of the incandescent bulb 10 in accordance with the user variable control 28. The power supply may alternatively vary the voltage across the light bulb, but this would require a more costly electrical design.

In addition the control system may include a temperature sensing means 29 which sense the temperature inside the butter conditioner, as an input to the power supply controller 26. In this instance, the user variable control 28 would provide an indicative temperature at which the user desires the butter conditioner to be maintained, with the power supply means 26 varying the supply of power to the incandescent bulb 10 in accordance with a feedback loop comparing the temperature inside the butter conditioner with the desired temperature set by the user variable control 28. The temperature sensing means may for example comprise a temperature probe depending from the inside surface of the fresh food compartment and penetrating the conditioner through an opening in the lid thereof.

While it is preferred that the refrigerator include a butter conditioning compartment into which butter can be placed, and the inside of which is kept at an elevated temperature, the light and control system of the present invention could also be utilised to directly heat a container of butter. For example butter supplied in a sealable plastic container might be directly heated by the light if appropriately placed.

From the above it can be seen that a household refrigerator is provided which has a highly versatile butter conditioner which is maintained on the refrigerator door, in a user-friendly manner, thereby making efficient use of refrigerator space. The butter conditioner is removable from the refrigerator door as a self-contained unit to be transported and returned as necessary. A means for heating the butter conditioner is provided which does not restrict the conduct of the butter conditioner or impinge on the space requirements of the refrigerator. The heating means also doubles as the refrigerator light, thereby reducing the electrical circuits required in the refrigerator. The light 10 is preferably positioned in the central forward portion of the ceiling of the refrigerator, which is a preferred position for casting illumination over the refrigerator contents. The butter conditioner 11 is located at the top of the refrigerator door, also in a desirable position. The butter conditioner 11 is maintainable in elevated temperature as compared to the remainder of the fresh food compartment 5 without the necessity of electrical circuits across the door hinge 9. This therefore is not restrictive on the hanging of the door from either side of the refrigerator, as demonstrated by the configurations of FIGS. 1 and 3 wherein the door hinge is located oppositely in each instance.

What is claimed is:

1. A refrigerator comprising:

an open fronted cabinet enclosing, but for said open front, a refrigeration space, a door connected to said cabinet to cover said open front when closed and to give access to said refrigerated space when open, a refrigeration system to refrigerate said refrigeration space, an enclosed subcompartment, said subcompartment supported on the door of said refrigerator, and a heating means not on said door, mounted proximate to said subcompartment with said door closed.

2. A refrigerator as claimed in claim 1 wherein said heating means is a light source.

3. A refrigerator as claimed in claim 1 wherein said subcompartment includes a substantially insulative wall adapted to reduce thermal communication between said compartment and said refrigeration space, and said wall includes an area of reduced insulative property in the vicinity of said heating means with said door closed.

4. A refrigerator as claimed in claim 1 including a control system to control the supply of energy to said heating means.

5. A refrigerator as claimed in claim 4 wherein said control system includes cycling means to cycle the supply of energy to said heating means in accordance with the thermal response of said enclosed subcompartment to said heating means.

6. A refrigerator as claimed in claim 1 wherein said subcompartment is removable as a unit from said refrigerator door.

7. A refrigerator comprising:

an open fronted cabinet enclosing, but for said open front, a refrigeration space, a door connected to said cabinet to cover said open front when closed and to give access to said refrigerated space when open, a refrigeration system to refrigerate said refrigeration space, an enclosed subcompartment, said subcompartment supported on the door of said refrigerator, and a light source in said cabinet, said light source located in said cabinet proximate to said subcompartment with said door closed, said light source being adapted to illuminate the contents of said refrigerator with said door open, and with said door closed is substantially blocked from illuminating the contents of said refrigerator by said enclosed subcompartment.

8. A refrigerator as claimed in claim 7 wherein said enclosed subcompartment is located at adjacent the top edge of said door and with said door closed is at least partially located within said refrigeration space, said light bulb is located in the top inside surface of said refrigeration space, adjacent the front edge thereof, and with said door closed said enclosed subcompartment is located directly below said light bulb and radiated and conducted heat from said light bulb is absorbed by said subcompartment.

9. A refrigerator which includes a butter conditioner characterised in that a passive butter compartment is mounted in the refrigerator door and that an incandescent light bulb is mounted in the refrigerator to illuminate the contents thereof with said door open, said light bulb mounted in a position such that the bulk of the radiation from the light bulb is received by the butter compartment when the refrigerator door is closed.

* * * * *